US006595665B1

(12) United States Patent
Park

(10) Patent No.: US 6,595,665 B1
(45) Date of Patent: Jul. 22, 2003

(54) MULTI-SHAPED LAMP SHADE ASSEMBLY AND METHOD FOR MAKING SAME

(76) Inventor: Hong Ku Park, 203 Southcrest Dr., Huntsville, AL (US) 35802

( * ) Notice: Subject to any disclaimer, the term of this patent is extended or adjusted under 35 U.S.C. 154(b) by 0 days.

(21) Appl. No.: 09/746,231

(22) Filed: Dec. 21, 2000

(51) Int. Cl.[7] ..... F21V 17/02

(52) U.S. Cl. ..... 362/449; 362/287; 362/351; 362/352; 362/361; 362/410; 362/427; 248/150; 248/165

(58) Field of Search ..... 362/287, 351–361, 362/367, 410, 413, 427, 434, 441, 442, 449, 450; 248/150, 165

(56) References Cited

U.S. PATENT DOCUMENTS

| | | | | |
|---|---|---|---|---|
| 2,819,386 A | | 1/1958 | Linderoth | 240/108 |
| 2,884,515 A | | 4/1959 | Fogel | 240/108 |
| 3,435,205 A | | 3/1969 | Paul | 240/108 |
| 4,061,913 A | | 12/1977 | Ross | 362/357 |
| 4,165,529 A | | 8/1979 | Hagelthorn | 362/352 |
| 4,233,656 A | | 11/1980 | Shemitz | 362/352 |
| 4,290,099 A | * | 9/1981 | Vicars-Harris | 362/352 |
| 4,758,936 A | | 7/1988 | Maxwell | 362/352 |
| 5,115,385 A | | 5/1992 | Jeckle | 362/358 |
| 5,375,048 A | | 12/1994 | Barnes | 362/352 |
| 5,662,412 A | | 9/1997 | Glendmyer | 362/351 |
| 5,746,506 A | | 5/1998 | Dunbar | 362/351 |
| 5,868,492 A | | 2/1999 | Strickland | 362/352 |

* cited by examiner

*Primary Examiner*—Sandra O'Shea
*Assistant Examiner*—Mark Tsidulko
(74) *Attorney, Agent, or Firm*—Charles R. Ducker, Jr.

(57) ABSTRACT

The present invention relates to lamp shades which may be formed from similar components in a wide variety of configurations such as cylindrical, box, tapered, and frusto-conical lamp shades, with the assembled lamp shade, after a covering is applied to a frame, has substantially the same aesthetic appeal as a conventional factory assembled lamp shade. The lamp shade of the present invention comprises a frame including a first peripheral edge member defined by a plurality of easily deformed T-shaped connectors secured at their arms to at least one, easily deformable, horizontally disposed strut, at least a second peripheral edge member defined by a plurality of easily deformable T-shaped connectors secured at their arms to at least one easily deformable, horizontally disposed, strut, a plurality of peripherally spaced rib members extended therearound and adapted for connection at its ends to the trunks of respective T-shaped connectors in the first and at least a second peripheral edge members, a spider member connected to the at least a second peripheral edge member, a light bulb engaging element associated with the spider member, and a covering made from a suitable material such as plain rice paper, fiberglass rice paper, silk or the like is secured to the frame to complete the lamp shade.

4 Claims, 12 Drawing Sheets

MULTI-SHAPED LAMP SHADE ASSEMBLY AND METHOD FOR MAKING SAME

FIELD OF THE INVENTION

This invention relates to lamp shades and shapes thereof, and more particularly to lamp shades that can be made from similar components to form both circular and polygonal cross sectional configurations.

BACKGROUND OF THE INVENTION

Conventional lamp shades have a typical circular or polygonal cross sectional configuration and are generally manufactured in a preformed or assembled condition prior to being shipped to the consumer. The conventional lamp shades are either circular in cross sectional configuration or polygonal in cross sectional configuration and are typically made from specially shaped components which are not interchangeable for the several configurations. Typically, lamp shades might be classified as being cylindrical or box shaped shades which might be mounted to lamps or light fixtures over the light bulb or under the light bulb. Typically, lamp shades are preassembled at the factory and are not adapted to be readily and easily assembled by the consumer without the need for tools not normally found in most households.

SUMMARY OF THE INVENTION

The present invention seeks to provide components for lamp shades which enables an unskilled consumer to assemble lamp shades of any desired cross sectional configuration whether circular or polygonal. The frame of lamp shades of the present invention may be formed from similar components in a wide variety of configurations such as cylindrical, box, tapered, and frusto-conical lamp shades, with the assembled lamp shade, after a covering is applied to the frame, having substantially the same aesthetic appeal as a conventional factory assembled lamp shade.

Broadly, each lamp shade of the present invention comprises a frame including a first peripheral edge member defined by a plurality of easily deformed T-shaped connectors secured at their arms to one or more, easily deformable, horizontally disposed struts, at least a second peripheral edge member defined by a plurality of easily deformable T-shaped connectors secured at their arms to one or more, easily deformable, horizontally disposed, struts, a plurality of peripherally spaced rib members extended therearound and adapted for connection at its ends to the trunks of respective T-shaped connectors in the first edge member and at least a second peripheral edge member, a spider member connected to the at least a second peripheral edge member, either a light bulb engaging element or a shade support element associated with the spider member, and a covering made from a suitable material such as plain rice paper, fiberglass rice paper, silk or the like is secured to the frame to complete the lamp shade.

Each of the first and second peripheral edge members is easily formed as an endless member with a variety of shapes such as circular, oval, elliptical and polygonal, depending on the desired configuration of the lamp shade. The lamp shades of the present invention might be suspended on a vertically disposed lamp such that the lamp shade opens in a downward direction to provide direct lighting or they may be mounted to a wall or ceiling light fixture such that they open in an upward or side direction to provide indirect lighting.

Accordingly, it is an object of this present invention to provide a simple, inexpensive, lamp shade that can be easily and rapidly assembled into a variety of configurations.

A further object of the present invention is to provide a lamp shade that can be easily assembled from common components into a number of cross sectional configurations without the need for special tooling or mechanical skills.

These objects as well as the objects and advantages of the present invention will become more readily apparent from the following description taken in conjunction with the accompanying drawings.

DETAILED DESCRIPTION OF THE PREFERRED EMBODIMENTS OF THE INVENTION

Figure 12:
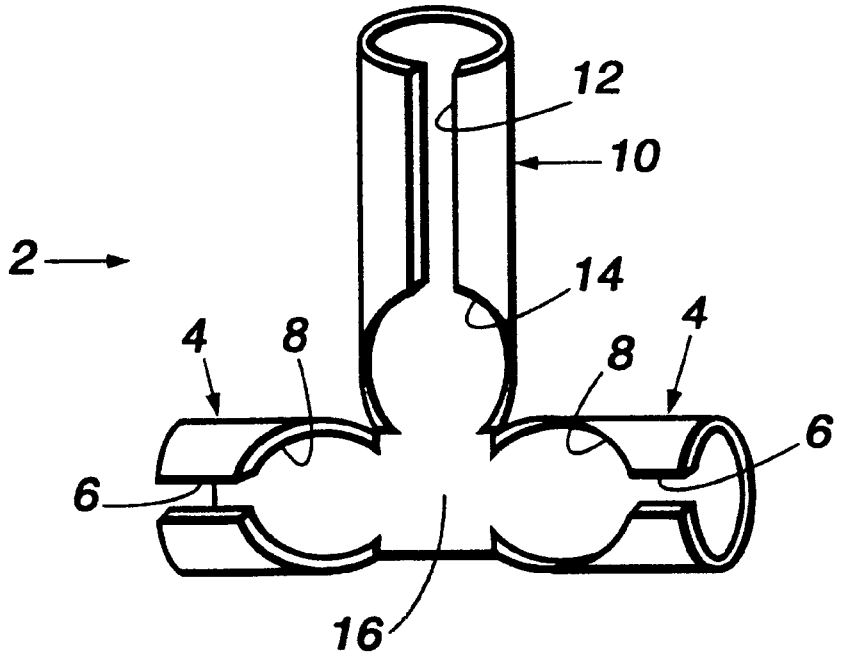
FIG. 12 is a perspective view of one of the T-shaped, easily deformable, connectors used in all embodiments of the lamp shade of the present invention.
Figure 13:
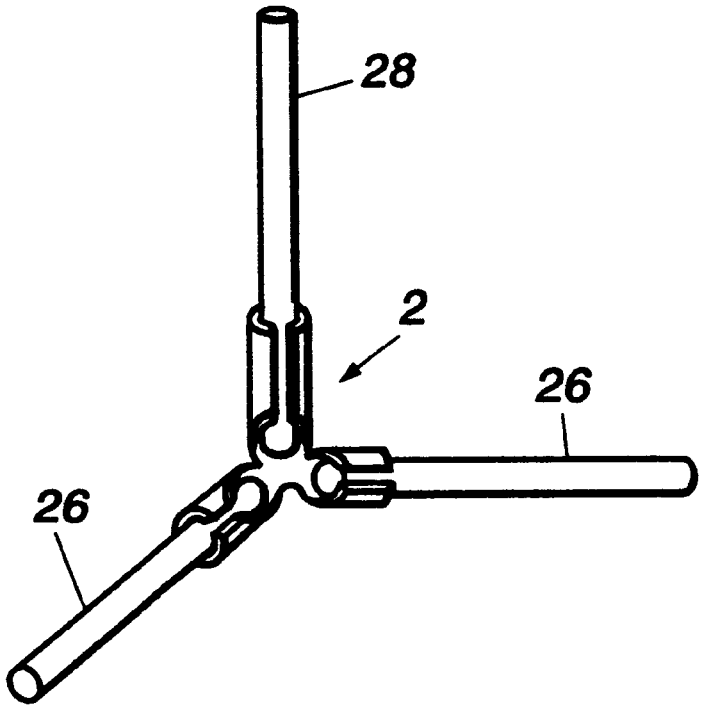
FIG. 13 is a perspective view of one of the T-shaped, easily deformable, connectors secured to two adjacent struts and one adjacent rib member.
Figure 14:
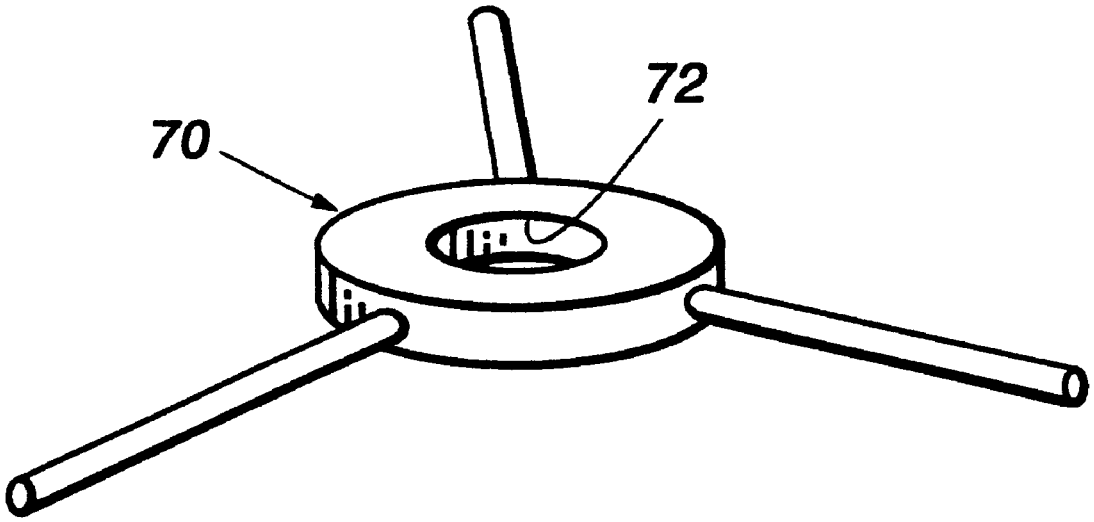
FIG. 14 is a perspective view of a spider member used in one or more embodiments of the lamp shade of the present invention.

FIGS. 12 and 13 illustrate, by way of example, a T-shaped, easily deformable and shaped, connector 2 which secures either two adjacent struts or a continuous single strut, and either straight or bent rib members in all embodiments of the lamp shades and frames of the present invention. Each T-shaped connector 2 comprises a pair of aligned arms 4, each having a slit 6 and a cut-out opening 8 therein, and a trunk 10 having a slit 12 and a cut-out opening 14 therein. The two cut-out openings 8 in the arms 4 and the cut-out opening 14 in the trunk 10 are contiguous to form a single large, shamrock shaped, opening 16 which allows the T-shaped connectors 2 to be easily shaped to form a frame and lamp shade of any selected configuration. The T-shaped connector 2 hereinabove described and illustrated in FIG. 12 is used numerous times in each embodiment of the present invention, thus like numerals represent like parts of each T-shaped connector 2 throughout the application.

Figure 1:
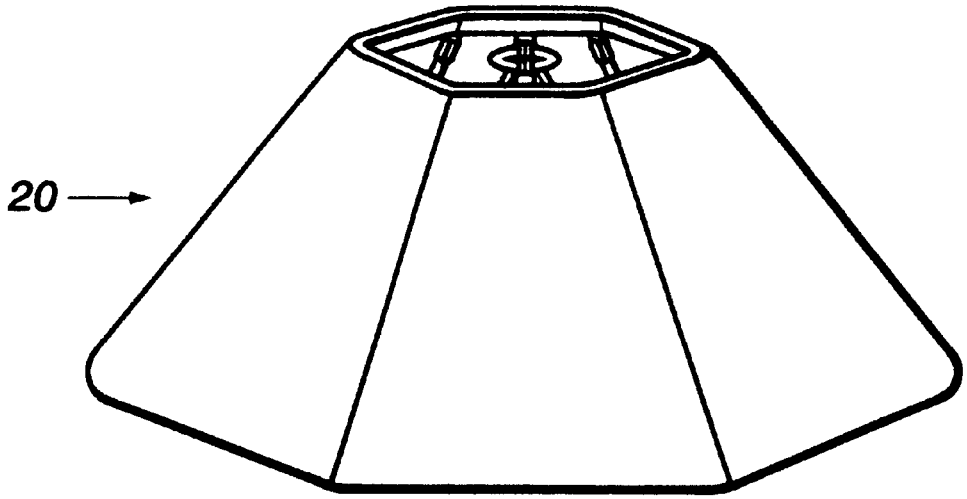
FIG. 1 is a perspective view of a first embodiment of the lamp shade of the present invention having a hexagonal cross section configuration.
Figure 2:
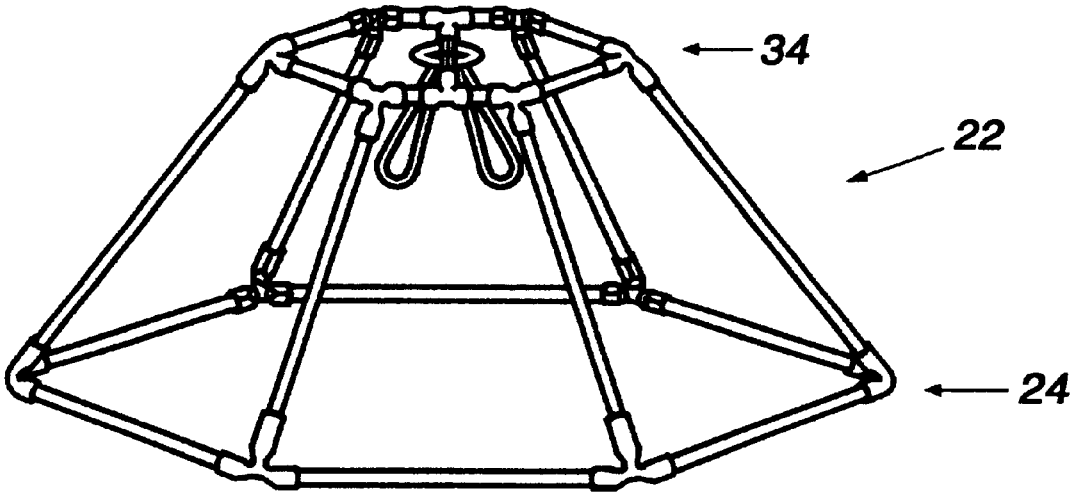
FIG. 2 is a perspective view of the first embodiment of the assembled frame for lamp shades of the present invention as depicted in FIG. 1 and having a hexagonal cross section configuration.
Figure 3:
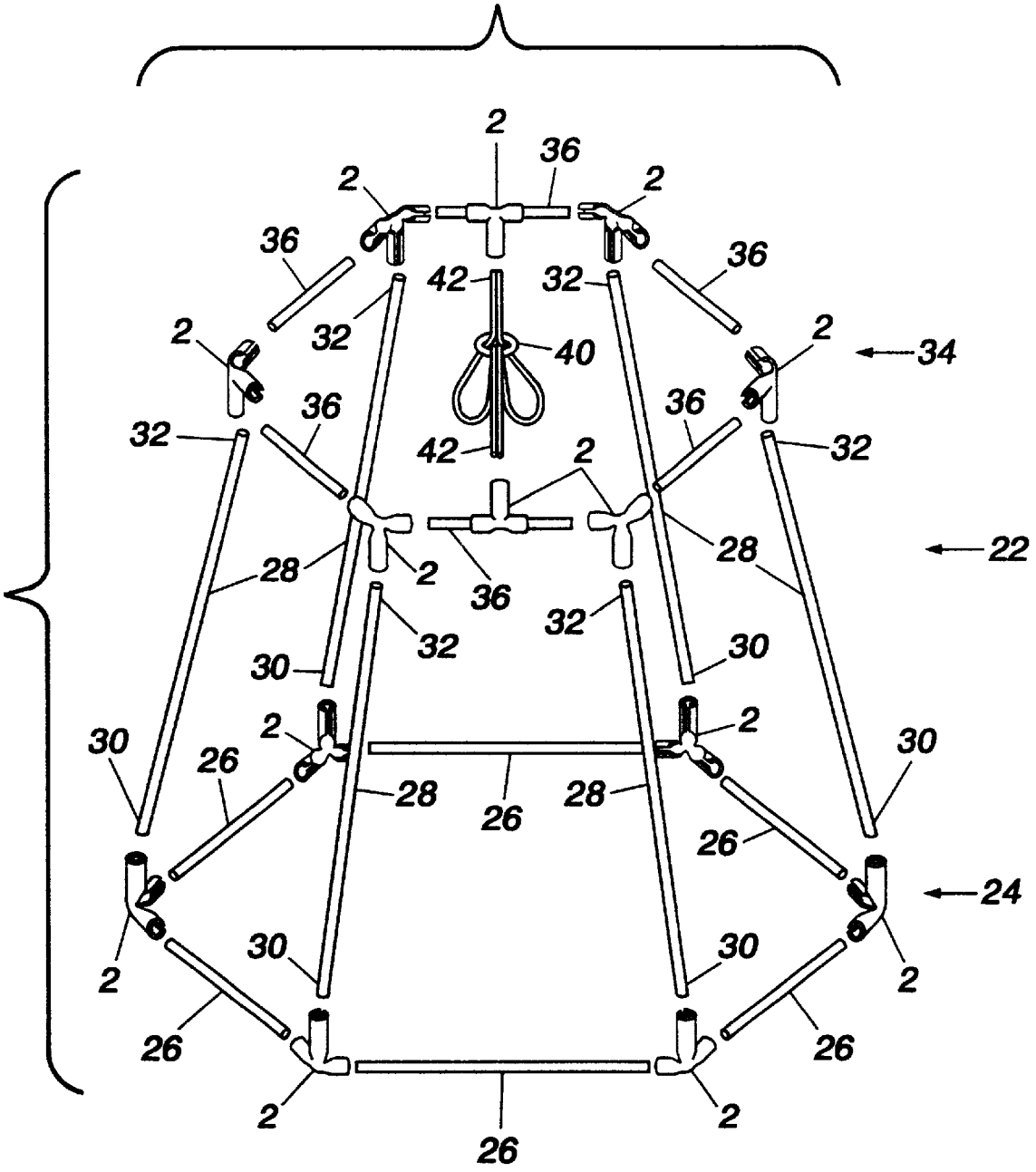
FIG. 3 is an exploded, perspective, view of the frame for the first embodiment of the lamp shade of the present invention as depicted in FIGS. 1 and 2 and having a hexagonal cross section configuration.
Figure 4:
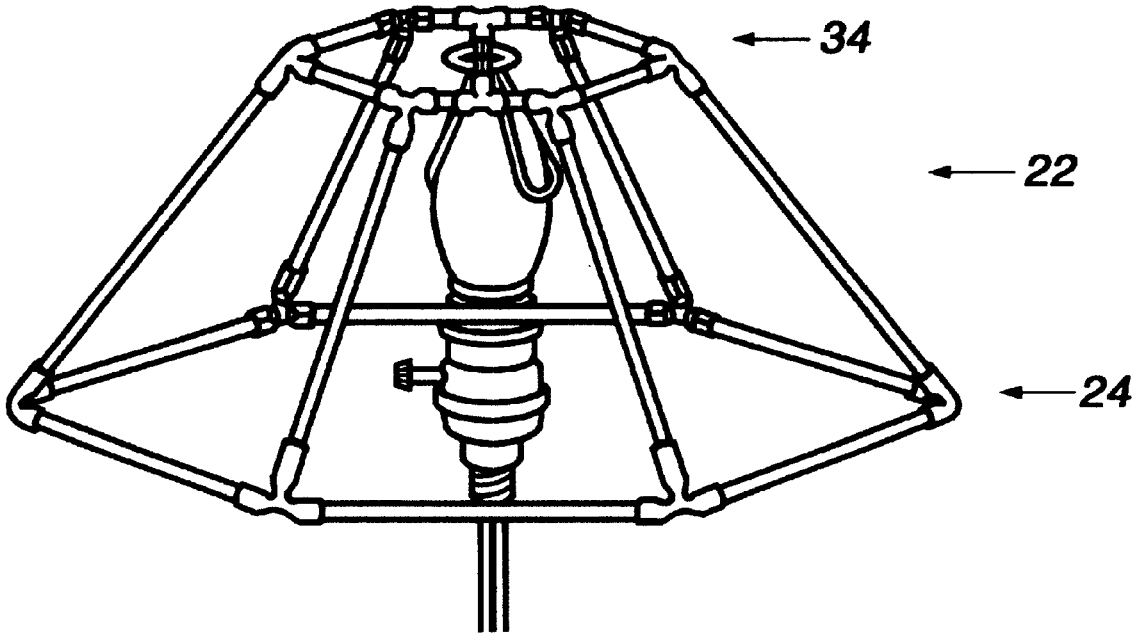
FIG. 4 is a perspective view of the frame for the first embodiment of the lamp shade, but with no covering, of the present invention and having a hexagonal cross section configuration and mounted on a vertically disposed light bulb for a lamp.
Figure 15:
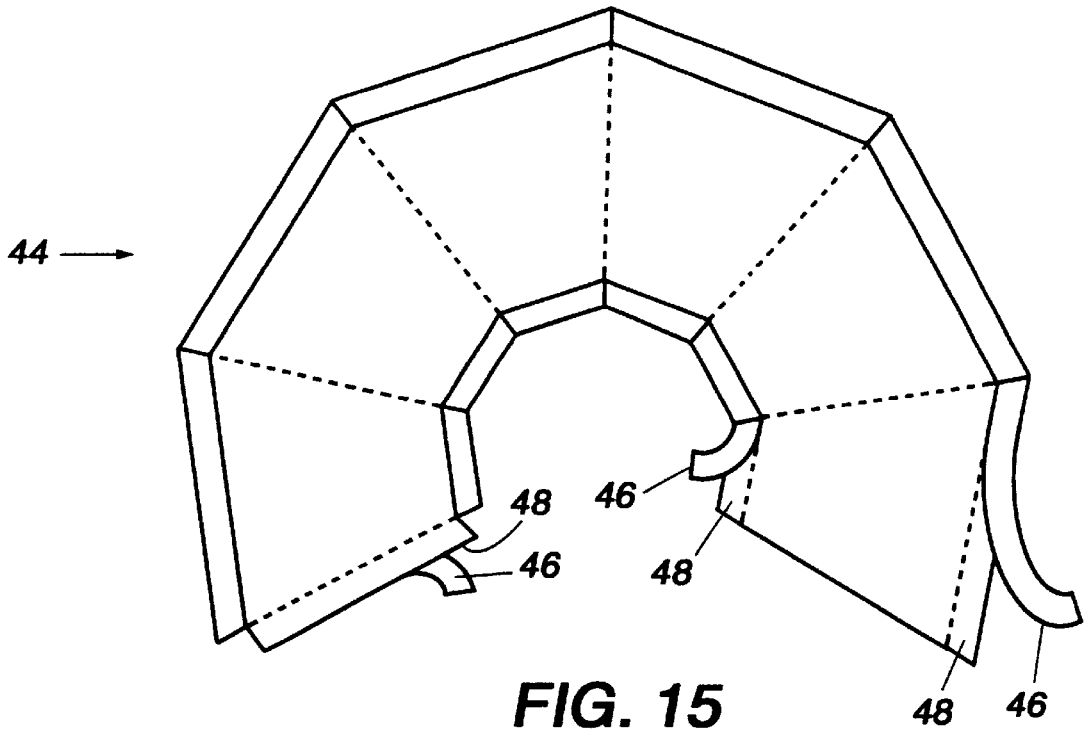
FIG. 15 is a perspective view of a covering for use with the first and third embodiments of the lamp shades of the present invention as depicted in FIGS. 1–4 and FIGS. 9–11 and having a hexagonal cross section configuration.

FIG. 1 illustrates, by way of example, a first embodiment of a lamp shade 20 having a hexagonal cross section configuration. As best seen in FIGS. 2 and 3, the frame 22 for the first embodiment, hexagonal shaped, lamp shade 20 comprises six T-shaped connectors 2 in a first (lower) peripheral edge member 24, each of which is connected by friction or a crimp to an adjacent strut 26 to secure one arm 4 of adjacent T-shaped connectors 2 with its trunk 10 being connected by friction or a crimp to one end 30 of a respective rib member 28 having a T-shaped connector 2 attached to its bent section (unnumbered); six T-shaped connectors 2 in a second (upper) peripheral edge member 34, whose arms are connected by friction or a crimp to an adjacent strut 36 with its trunk 10 being secured by friction or a crimp to the other end 32 of a respective rib member 28 having a connector 2 attached to its bent section (unnumbered); two additional T-shaped connectors 2 in the second (upper) peripheral edge member 34 whose arms 4 telescopically receives two of the struts 36 in the second (upper) peripheral edge member 34 and being frictionally or crimpily secured to adjacent T-shaped connectors 2; and a light bulb engaging element 40 having ends 42 which are frictionally or crimpily received in the trunk 10 of each of the two additional T-shaped connectors 2. In the first embodiment of the present invention as depicted in FIGS. 1–3, the arms 4 and the trunks 10 of all T-shaped connectors 2 except for the two additional ones in the second (upper) peripheral edge member 34 can be slightly bent at the cut-out areas 8 to provide the angles necessary for a hexagonal shaped configuration. The arms 4 and trunks 10 of the two additional T-shaped connectors 2 in the second (upper) peripheral edge member 34 need not be slightly bent as their arms 4 are in alignment or in the same plane and each of their trunks 10 are at a ninety degree angle with respect to the arms 4. In the embodiment of FIGS. 1–3, an assembler might use a conventional crimping tool (not shown) for respectively crimping the arms 4 and trunk 10 of each T-shaped connector 2 to the adjacent struts 36 or rib member 28. Once the frame 22 is assembled as best seen in FIG. 2, a person can easily and rapidly secure the covering 44, as best seen in FIG. 15, to the frame 22 by removing the adhesive protecting strips 46 from the covering 44 to expose the adhesive 48 and folding over the outer edges of the covering 44 to secure the covering 44 to the frame 22. At this point in time, a person merely has to place the light bulb engaging element 40 of the assembled lamp shade onto the light bulb of the lamp (unnumbered) as best seen in FIG. 4, but without the covering 44.

Figure 5:
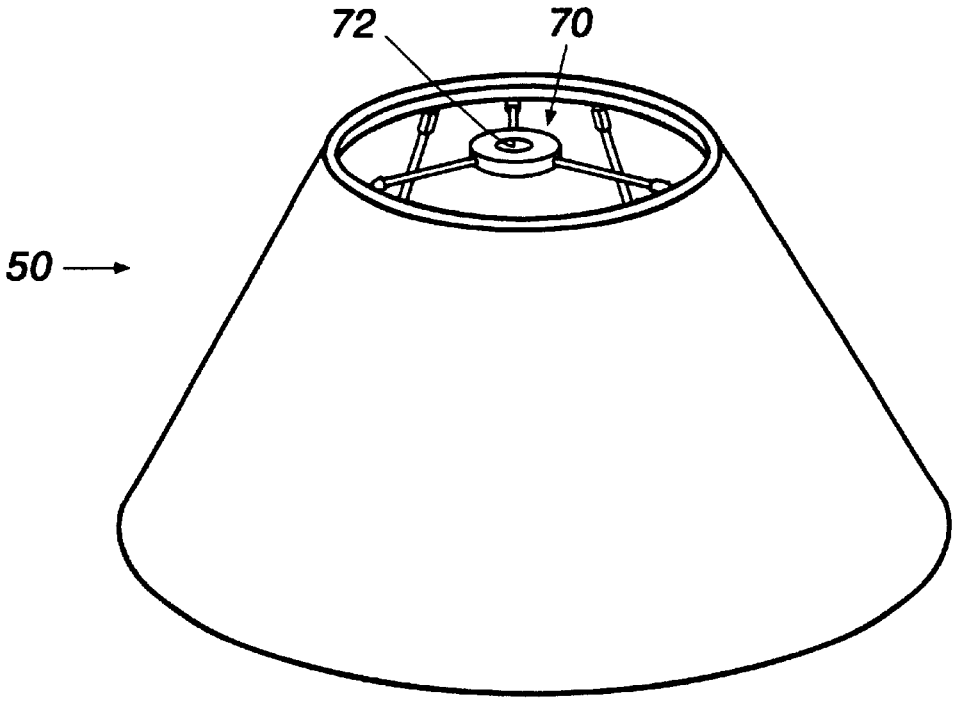
FIG. 5 is a perspective view of a second embodiment of the lamp shade of the present invention having a circular cross section configuration.
Figure 6:
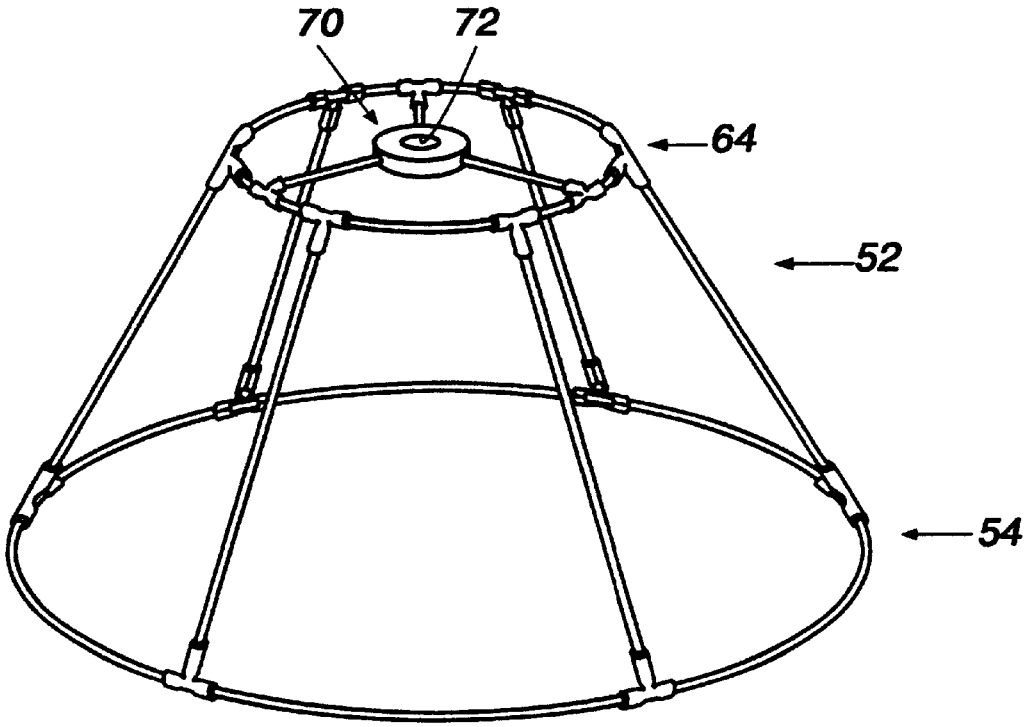
FIG. 6 is a perspective view of the second embodiment of the assembled frame for the lamp shade of the present invention as depicted in FIG. 5 and having a circular cross section configuration.
Figure 7:
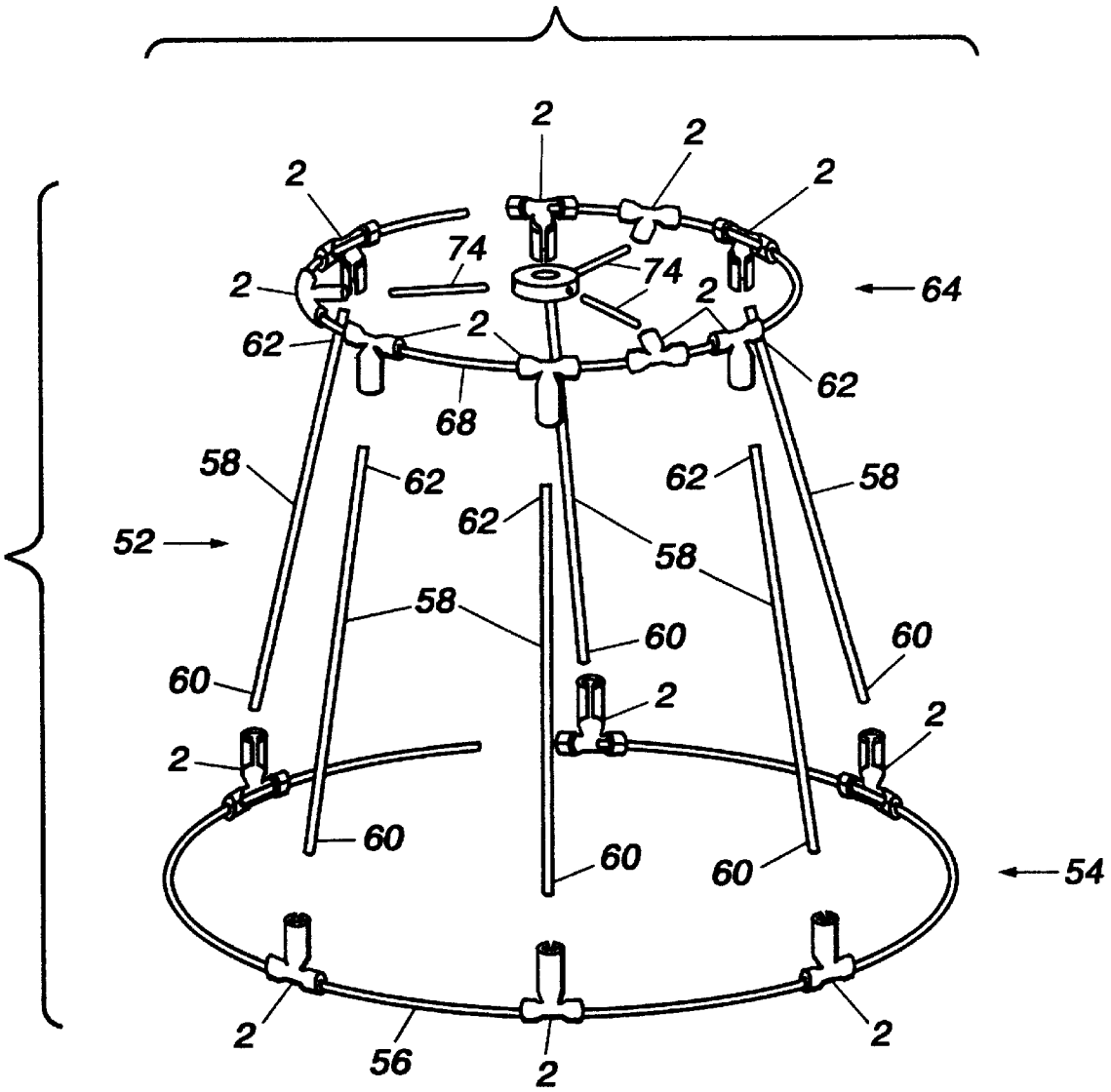
FIG. 7 is an exploded, perspective, view of the frame for the second embodiment of the lamp shade of the present invention as depicted in FIGS. 5 and 6 and having a circular cross sectional configuration.
Figure 8:
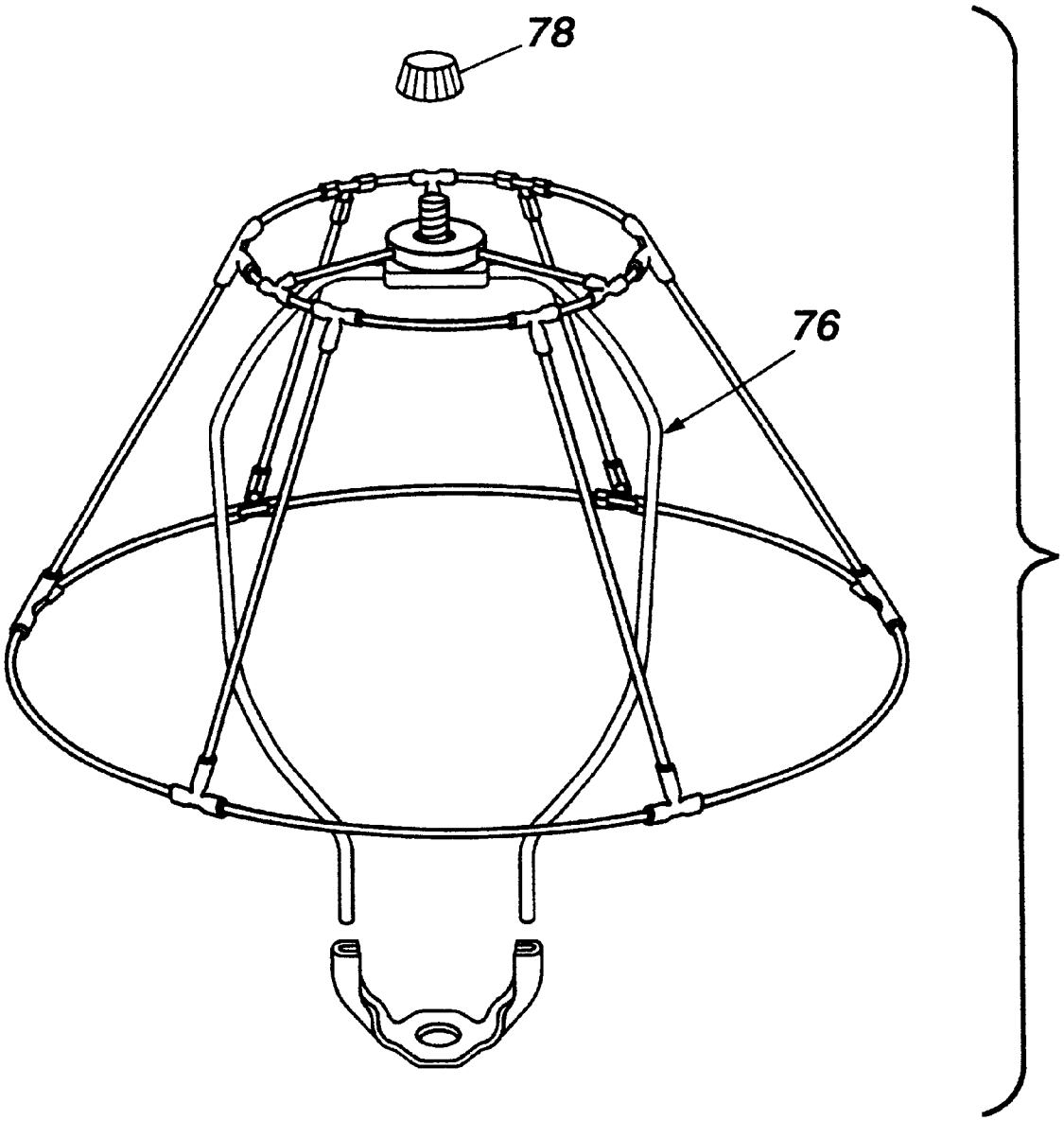
FIG. 8 is an exploded, perspective, view of the frame for the second embodiment of the frame for the second embodiment of the lamp shade, but with no covering, of the present invention and having a circular cross section configuration and mounted on a vertically disposed conventional shade support.
Figure 16:
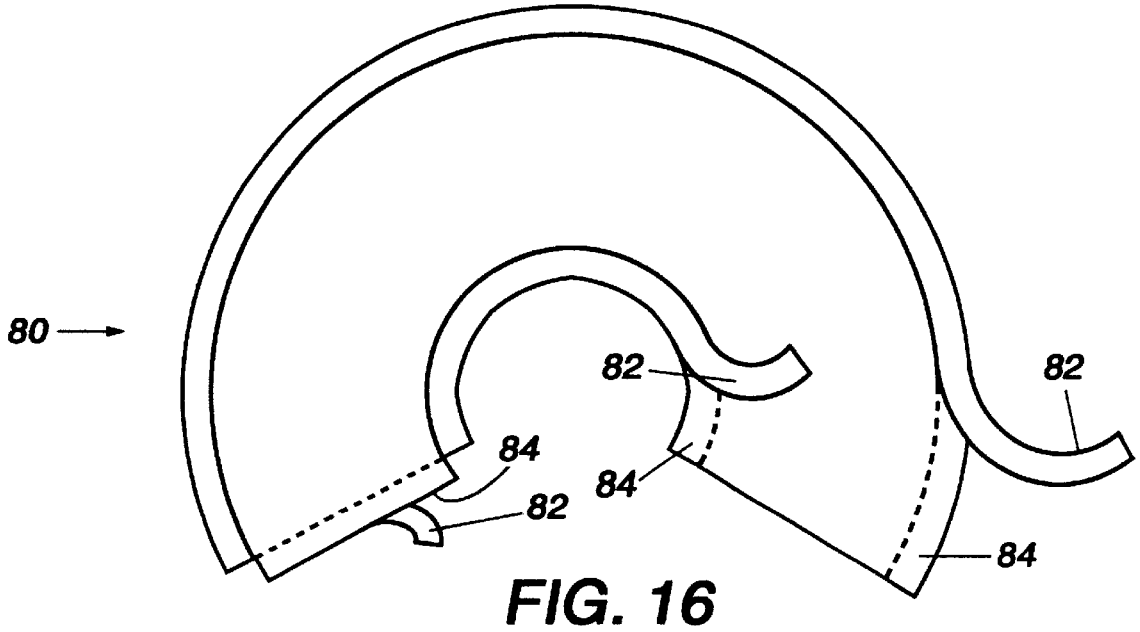
FIG. 16 is a perspective view of a covering for use with the second embodiment of the lamp shade of the present invention as depicted in FIGS. 5–8 and having a circular cross section configuration.
Figure 1:
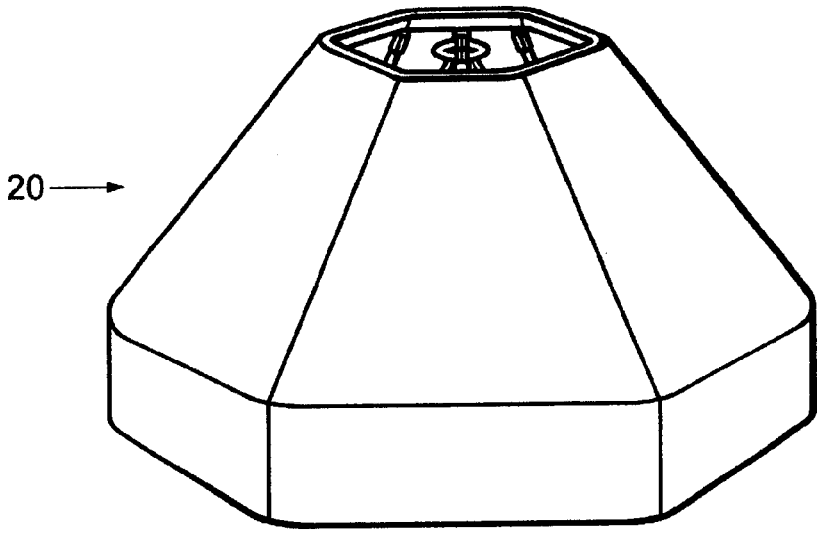
Figure 2:
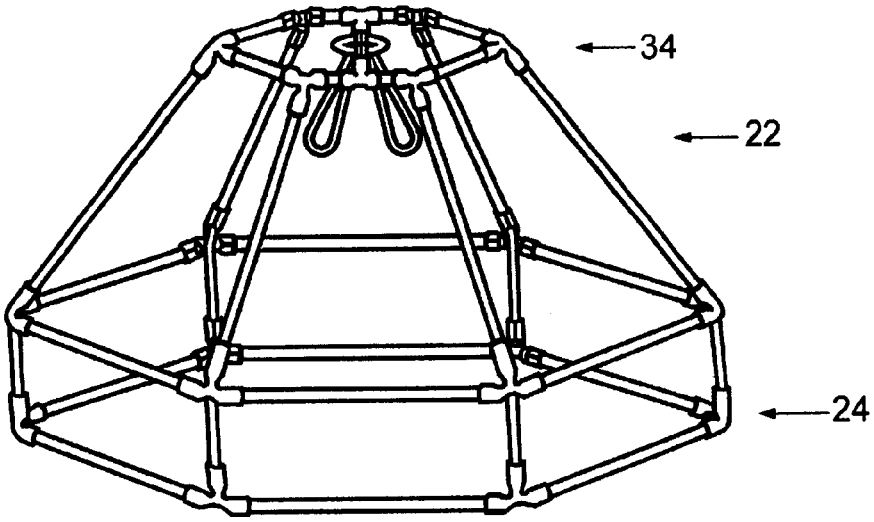
Figure 3:
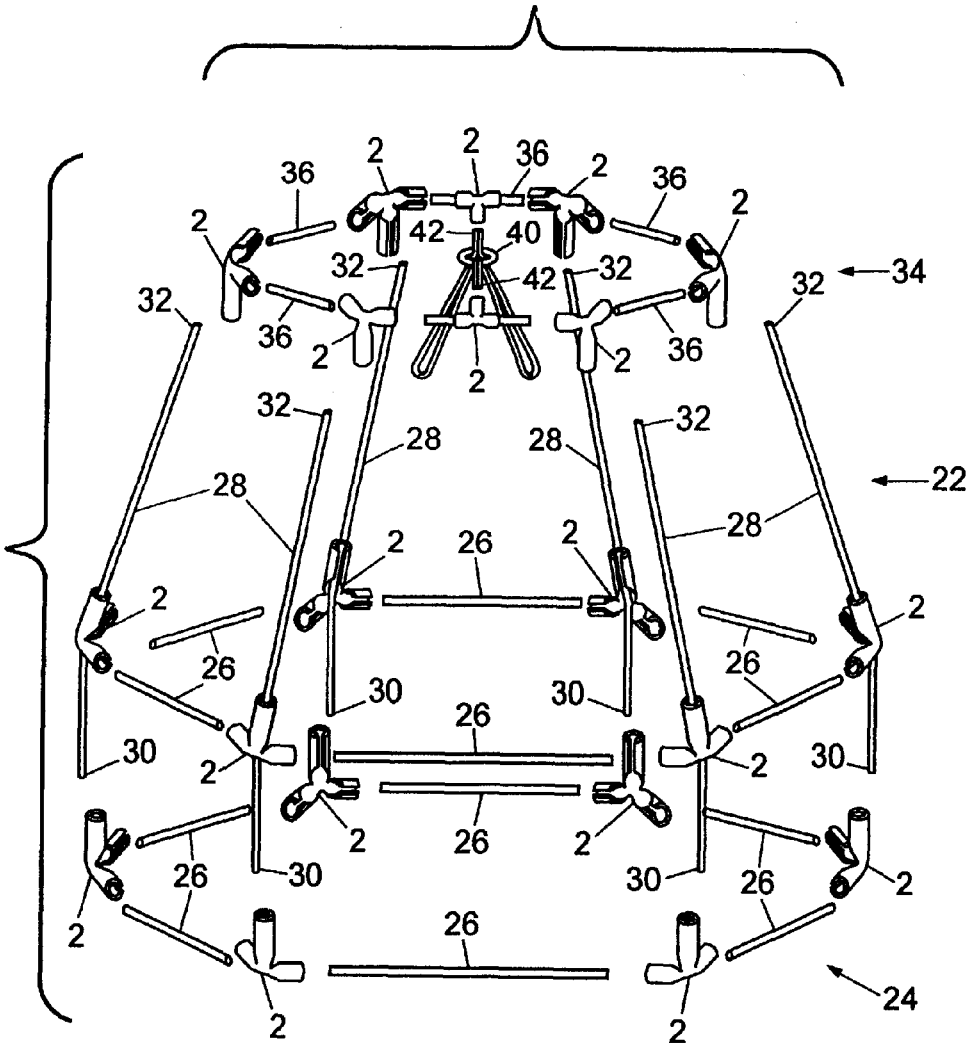
Figure 4:
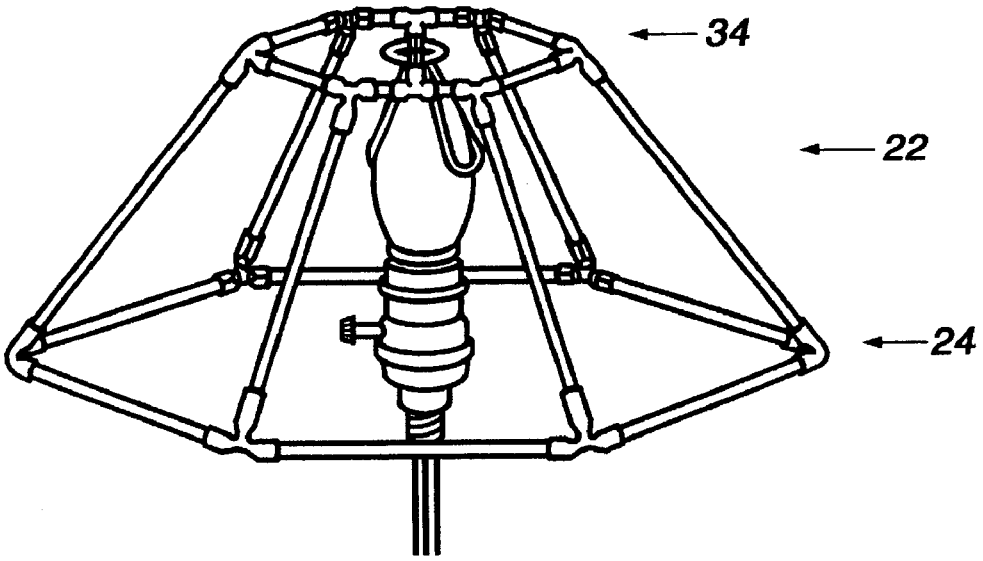
Figure 12:
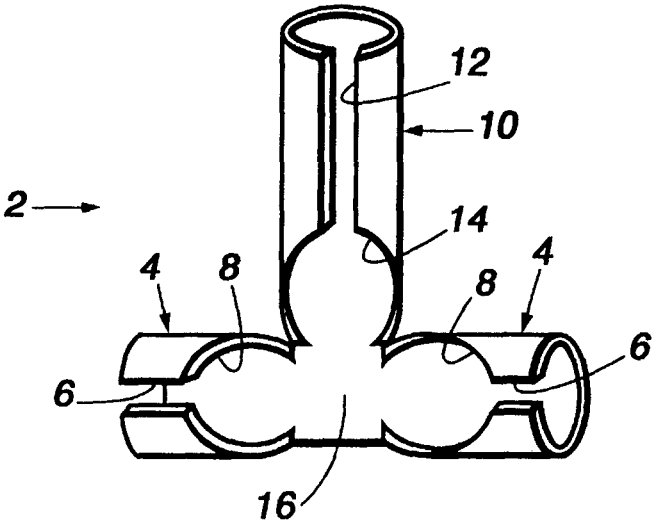
Figure 13:
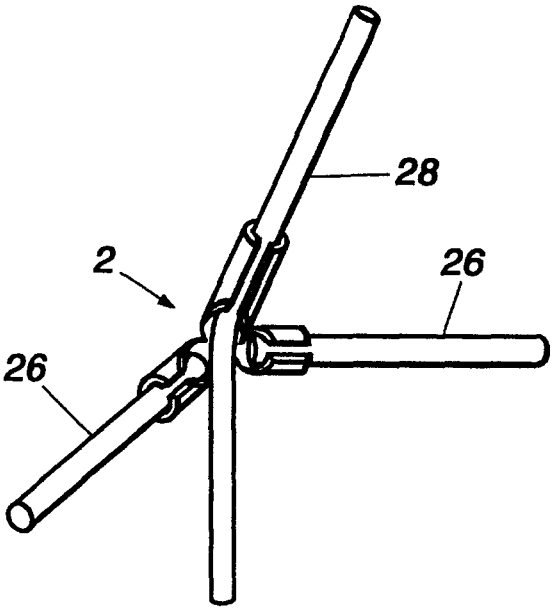

FIG. 5 illustrates, by way of example, a second embodiment of a lamp shade 50 having a circular cross section configuration. As best seen in FIGS. 6–8, the frame 52 for the second embodiment, circular shaped, lamp shade 50 comprises six T-shaped connectors 2 in a first (lower) peripheral edge member 54, each of which is connected to a continuous, one-piece, strut 56 which is threaded through the openings (unnumbered) in the arms 4 of each T-shaped connector 2 to frictionally secure each arm 4 of adjacent T-shaped connectors 2 by crimping with its trunk 10 being crimped to one end 60 of a respective rib member 58; six T-shaped connectors 2 in a second (upper) peripheral edge member 64, each of which is connected to a continuous, one piece strut 56 which is threaded through the openings (unnumbered) in the arms 4 of each T-shaped connector 2 of adjacent T-shaped connectors 2 by crimping or friction with its trunk 10 being crimped to the other end 62 of a respective rib member 58; three additional T-shaped connectors 2 in the second (upper) peripheral edge member 64 whose openings (unnumbered) in arms 4 telescopically receive continuous, one-piece, strut 68 (FIG. 7) in the second (upper) peripheral edge member 64; and a spider element 70 (FIG. 5) having a central opening 72 and ends 74 which are frictionally received in the trunk 10 of each of the three additional T-shaped connectors 2. In the second embodiment of the present invention as depicted in FIGS. 5–8, the arms 4 of the six T-shaped connectors 2 in the first (lower) peripheral edge member 54 and the second (upper) peripheral edge member 64 can be slightly bent at the cut-out areas 8 to provide the angles and circular shaped configuration. In the second embodiment as depicted in FIGS. 5–8, an assembler might also use a conventional crimping tool (not shown) for crimping the arms 4 and trunk 10 of each T-shaped connector 2 respectively to an adjacent strut or rib member. Once the frame 52 is assembled as best seen in FIG. 5, a person can easily and rapidly secure the covering 80, as best shown in FIG. 16, to the frame 52 by removing the adhesive protecting strips 82 from the covering 80 to expose the adhesive 84 and folding over the outer edges of the covering 80 to secure the covering 80 to the frame 52. At this point in time, and referring to FIG. 8, a person merely has to place a conventional shade support member 76 over the light bulb (unnumbered) and placing the assembled lamp shade 50 onto the conventional shade support 76 and anchoring the shade 50 by tightening the nut 78.

Figure 9:
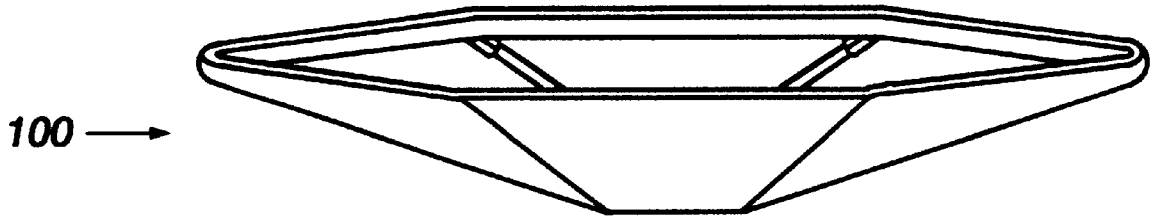
FIG. 9 is a perspective view of a third embodiment of the lamp shade of the present invention for mounting on a ceiling or wall light fixture and having a hexagonal cross section configuration.
Figure 10:
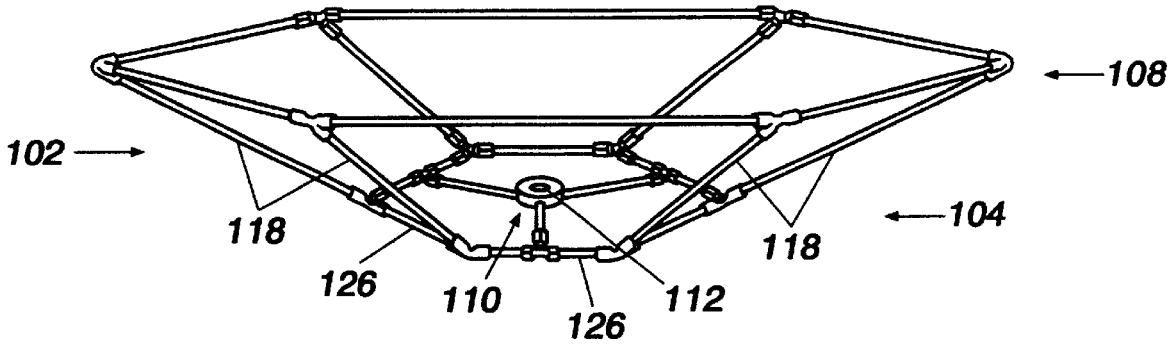
FIG. 10 is a perspective view of the frame for the third embodiment of the lamp shade depicted in FIG. 9 for mounting on a ceiling or wall light fixture and having a hexagonal cross section configuration.
Figure 11:
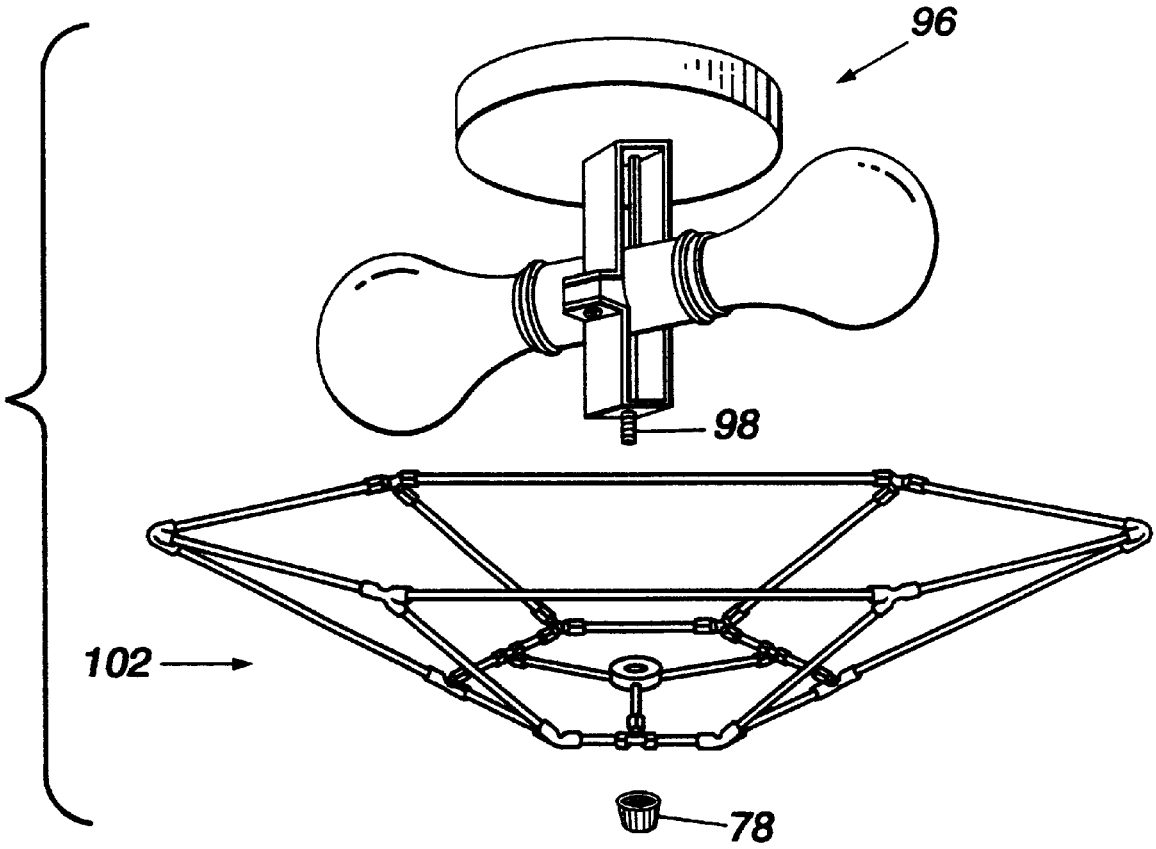
FIG. 11 is an exploded, perspective, view of the third embodiment of the lamp shade, but with no covering, of the present invention as depicted in FIGS. 9 and 10 about to be mounted on a ceiling light fixture and having a hexagonal cross section configuration.

FIG. 9 illustrates, by way of example, a third embodiment of a lamp shade 100 having a hexagonal cross section configuration for mounting to a ceiling or wall light fixture 96 (FIG. 11). As best seen in FIGS. 10 and 11, the frame 102 for the third embodiment, hexagonal shaped, lamp shade 100 comprises six T-shaped connectors 2 in a first (lower) peripheral edge member 104, each of which is connected by crimping or friction to an adjacent strut 126 to secure each arm 4 of adjacent T-shaped connectors 2 to a strut 126 with its trunk 10 being connected by crimping or friction to one end 120 of a respective rib member 118; six T-shaped connectors 2 in a second (upper) peripheral edge member 108, each of which is connected by crimping or friction to an adjacent strut 126 secured to one arm 4 of adjacent T-shaped connectors 2 with its trunk 10 being secured by crimping or friction to the other end 122 of a respective rib member 118; three additional T-shaped connectors 2 in the first (lower) peripheral edge member 104 whose arms 4 receives a respective strut 126 in the first (lower) peripheral edge member 104; and a spider element 110 having a central opening 112. In the third embodiment of the present invention as depicted in FIGS. 9–11, the arms 4 of the six T-shaped connectors 2 in the first (lower) peripheral edge member 104 and the second (upper) peripheral edge member 108 can be slightly bent at the cut-out areas 8 to provide the angles necessary for a hexagonal shaped configuration. The arms 4 and trunk 10 of the three additional T-shaped connectors 2 in the second (upper) peripheral edge member 108 need not be slightly bent as their arms 4 are in alignment or in the same plane and each of their trunks 10 are at a ninety degree angle with respect to the arms 4. In the third embodiment as depicted in FIGS. 9–11, an assembler might also use a conventional crimping tool (not shown) for crimping the arms 4 and trunk 10 of each T-shaped connector 2 respectively to an adjacent strut or rib member. Once the frame 102 is assembled as best seen in FIGS. 10 and 11, a person can easily and rapidly secure the covering 44, as best shown in FIG. 15, to the frame 102 by removing the adhesive protecting strips 46 and 48 from the covering 44 to expose the adhesive 48 and folding over the outer edges of the covering 44 to secure the covering 44 to the frame 102. At this point in time, and referring to FIG. 11, a person merely has to place central opening 112 in the spider element 110 of the assembled light shade 100 onto the threaded portion 98 of the conventional ceiling light fixture 96 to anchor the lamp shade 100 to the light fixture 100 by tightening the nut 78.

The foregoing is provided for purposes of illustration, explanation, and description of the preferred embodiments of the present invention. Modification, variations and adaptations of these embodiments will be apparent to those of ordinary skill in the art and they may be made without departing from the scope or spirit of the invention. For example, it is apparent that the covering 44, as best depicted in FIG. 15, and the covering 80, as best depicted in FIG. 16, could be made in a plurality of pieces of material rather than a single piece of material as shown.

I claim:

1. A frame for a lamp shade, comprising:

a) a lower peripheral edge member, including a plurality of deformable T-shaped connectors, said T-shaped connector having a pair of horizontally disposed arms and a single vertically disposed trunk, and at least one either deformable or nondeformable, horizontally disposed; strut adapted for connection to an adjacent one of said pair of horizontally disposed arms;

b) at least one upper peripheral edge member, including a plurality of said T-shaped connectors and at least one of said horizontally disposed strut;

c) a plurality of peripherally spaced rib members having end portions, each said end portion being adapted for connection to an adjacent one of said vertically disposed trunks of respective said T-shaped connectors in said lower and said at least one upper peripheral edge member; and d) wherein each of said horizontally disposed arms and each of said vertically disposed trunks of said T-shaped connectors include a cut-out opening therein, and wherein said cut-out openings are contiguous to form a single, shamrock-shaped opening within each T-shaped connector and which allows said T-shaped connectors to be easily shaped to form said frame in a multiplicity of selected configuration.

2. The frame of claim 1 wherein said lower peripheral edge member can be of any size and any configuration including circular and polygonal configurations.

3. The frame of claim 1 wherein said at least one upper peripheral edge member can be of any size and any configuration including circular and polygonal configurations.

4. The frame of claims 2 and 3 wherein said lower peripheral edge member and said at least one upper peripheral edge member can be connected by adapting each said end portion of said rib members to an adjacent one of said vertically disposed trunk of respective ones of said T-shaped connectors in said lower and said at least one upper peripheral edge members, and wherein said combination can form said frame in any configuration including circular and polygonal configurations.

* * * * *

UNITED STATES PATENT AND TRADEMARK OFFICE

CERTIFICATE OF CORRECTION

PATENT NO. : 6,595,665 B1
DATED : July 22, 2003
INVENTOR(S) : Hong Ku Park

It is certified that error appears in the above-identified patent and that said Letters Patent is hereby corrected as shown below:

Drawings,
Please delete Figs. 1, 2, 3 and 10, and replace with Figs. 1, 2, 3 and 10 hereby attached.

Signed and Sealed this

Twentieth Day of January, 2004

JON W. DUDAS
*Acting Director of the United States Patent and Trademark Office*